United States Patent [19]

Goff

[11] 3,977,128

[45] Aug. 31, 1976

[54] SURFACE TREATING APPARATUS

[76] Inventor: James R. Goff, 6601 Shawnee Drive, Oklahoma City, Okla. 78116

[22] Filed: Apr. 21, 1975

[21] Appl. No.: 569,727

[52] U.S. Cl. ..... 51/9 M

[51] Int. Cl.[2] ..... B24C 3/06

[58] Field of Search ..... 51/9 M, 9 R, 12; 241/DIG. 10

[56] References Cited

UNITED STATES PATENTS

| | | | |
|---|---|---|---|
| 1,634,385 | 7/1927 | Rapp | 241/DIG. 10 |
| 3,034,262 | 5/1962 | Pawlson | 51/9 M |
| 3,566,543 | 3/1971 | Fogle | 51/9 M |
| 3,691,689 | 9/1972 | Goff | 51/9 M |

*Primary Examiner*—Al Lawrence Smith
*Assistant Examiner*—James G. Smith
*Attorney, Agent, or Firm*—Beveridge, DeGrandi, Kline & Lunsford

[57] ABSTRACT

An improved abrasive throwing machine comprises an enclosure having means therein for projecting abrasive particles at an inclined angle relative to a surface to be treated. The improvement comprises rotatable means within the enclosure capable of propelling spent abrasive particles that rebound from the surface, and returning such particles to the projecting means. The rotatable means is typically a brush of substantially circular cross-section. The apparatus is especially well suited for cleaning substantially flat, horizontal surfaces, such as the tops of storage tanks, decks of naval vessels, roadways and aisleways.

10 Claims, 3 Drawing Figures

SURFACE TREATING APPARATUS

This invention relates to abrading machines, and more particularly, machines having means for blasting a surface to be treated with sand or other abrasive.

Abrading machines are well known in the art. One such machine adapted for use on flat, horizontal surfaces is disclosed in U.S. Pat. No. 3,691,689, issued Sept. 19, 1972. This machine comprises an enclosure having an opening adapted to contact the surface to be treated. The opening in the enclosure is surrounded by a resilient seal. A centrifugal blast wheel projects abrasive particles onto the surface. Spent abrasive particles accumulate on the surface being treated. As the machine moves forward, the spent abrasive particles lying on the surface pass under the resilient seal, and are picked up by a rotating brush located behind the enclosure. The spent abrasive that is picked up is thrown upward and forward into a collection bin by the rotating brush.

There are several disadvantages associated with the use of this machine for cleaning flat surfaces. First of all, one occasionally encounters surfaces that are difficult to clean. In such an instance, it is frequently necessary to reduce the rate of forward movement of the machine or to operate the machine in a stationary position for a period of time. The machine disclosed in U.S. Pat. No. 3,691,689, however, cannot be operated in a stationary position for too long a period of time because the spent abrasive accumulates on the surface being treated. The abrasive that falls dead within the blast zone eventually masks the surface to be treated, and very little cleaning is accomplished. The machine must be moved forward in order for the spent abrasive to clear the work area.

Secondly, the rotating brush is generally operated at a constant speed for a given application. While blasting at a relatively slow rate of forward movement, abrasive is picked up by the rotating brush at the same rate as it is thrown, regardless of the size of the pile of abrasive between the resilient seal and the rotating brush. When the operator increases the rate of forward movement of the machine, a large quantity of abrasive suddenly appears between the seal and the rotating brush. This large quantity of abrasive must be reclaimed within a very short period of time, and can jam the material handling system.

Thirdly, in order to blast continuously with the device disclosed in U.S. Pat. No. 3,691,689, the device must be capable of carrying a quantity of abrasive sufficient to supply the blast wheel, and at the same time allow for the spent abrasive accumulated on the surface being treated. This spent abrasive lying on the surface performs no useful function, but adds to the overall weight of the cleaning apparatus. This additional weight of the cleaning apparatus might be considerable when metal shot is used as the abrasive. This is especially disadvantageous when the tops of storage tanks are being cleaned, because the tops are not designed to support concentrated static or dynamic forces.

Thus, it will be apparent that there exists a need in the art for a surface cleaning machine capable of operating at variable speeds and even in a stationary position for extended periods of time. The abrasive cleaning machine should be light in weight so as to render it especially useful for cleaning surfaces that cannot withstand heavy loads.

This invention aids in fulfilling these needs by providing an improved abrasive throwing machine. The machine of this invention comprises an enclosure having an opening therein adapted to confront a surface to be treated, and means within the enclosure for projecting abrasive particles at an inclined angle relative to the surface and into a blast zone on the surface. Resilient sealing means are provided around the periphery of the opening in the enclosure to substantially deter the escape of spent abrasive from the enclosure. Means are also provided within the enclosure for returning spent abrasive to the projecting means. More particularly, this invention relates to an improvement which comprises rotatable means provided in the means for returning spent abrasive to the projecting means. The rotatable means is within the enclosure or at least in communication with the path defined by the rebounding particles. Further, the rotatable means is capable of propelling spent abrasive particles rebounding from the surface.

This invention also provides an abrasive throwing machine comprising an enclosure having an opening therein, and sealing means around the periphery of the opening to contact a surface to be treated and to retard the escape of spent abrasive from the enclosure. Means are provided within the enclosure for projecting abrasive particles along an incident path to a blast zone on the surface and from the blast zone along a rebound path. The projecting means is oriented so as to establish each of the incident path and rebound path at acute angles relative to the surface. Means are provided for returning spent abrasive along a spent abrasive recycle path to the projecting means. The improvement comprises rotatable means positioned in the rebound path for propelling spent abrasive particles along the recycle path.

Additionally, this invention provides a mobile abrasive blasting machine for treating horizontal surfaces. The machine comprises an enclosure having an opening therein adapted to confront the horizontal surface, at least one centrifugal blast wheel within the enclosure for projecting abrasive particles at an inclined angle relative to the surface and against a blast zone on the surface, resilient sealing means around the periphery of the opening to contact the surface and to substantially retard the escape of spent abrasive from the enclosure, and means for returning spent abrasive to the blast wheel. The improvement comprises at least one rotatable brush within the enclosure. The rotatable brush is positioned in front of the blast zone and removed from the surface. The brush is capable of striking spent abrasive particles rebounding from the surface and throwing them along a recycle path to the blast wheel. A rear portion of the resilient sealing means includes a second brush means having passages therethrough for the entry of air into the enclosure, and means are provided for drawing air through this brush.

Further, this invention provides a method for treating a surface. The method comprises projecting abrasive particles at an inclined angle relative to the surface to abrade the surface and to cause the particles to rebound from the surface. The rebounding particles are then struck and thrown along a predetermined path, usually into a storage hopper.

Additionally, this invention provides an apparatus for continuously conveying particulate material rebounding from a surface at an acute angle relative to the surface. The apparatus comprises a hopper for receiving the particulate material and rotatable means positioned in a rebound path defined by the rebounding particles. The rotatable means, which is preferably a rotating brush, strikes the particles and throws the particles along a predetermined path to the hopper.

This invention will be more fully understood by reference to the drawings described in detail hereinafter. In the drawings.

Figure 1:
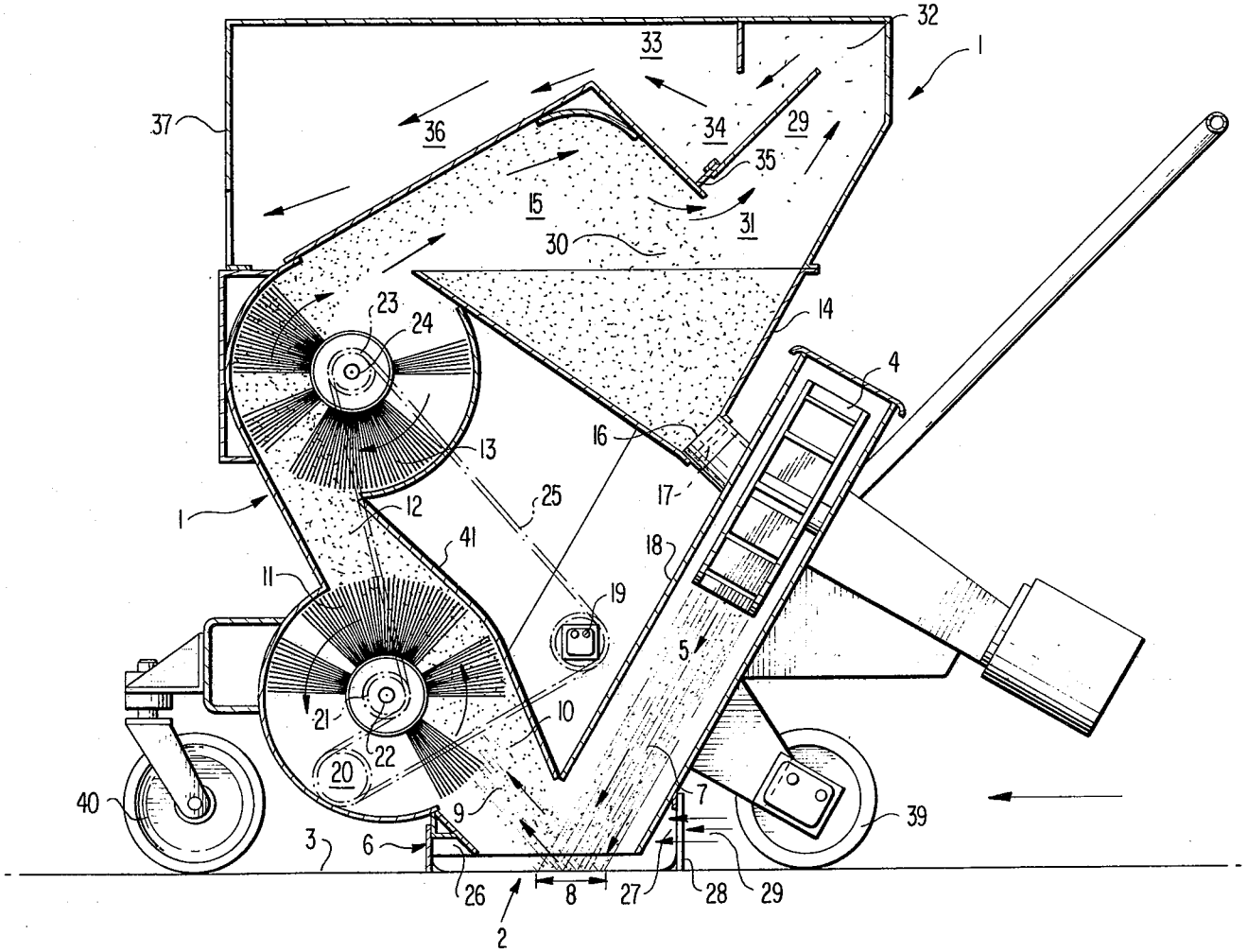
FIG. 1 is a cross-sectional view of a preferred surface treating machine of this invention.
Figure 2:
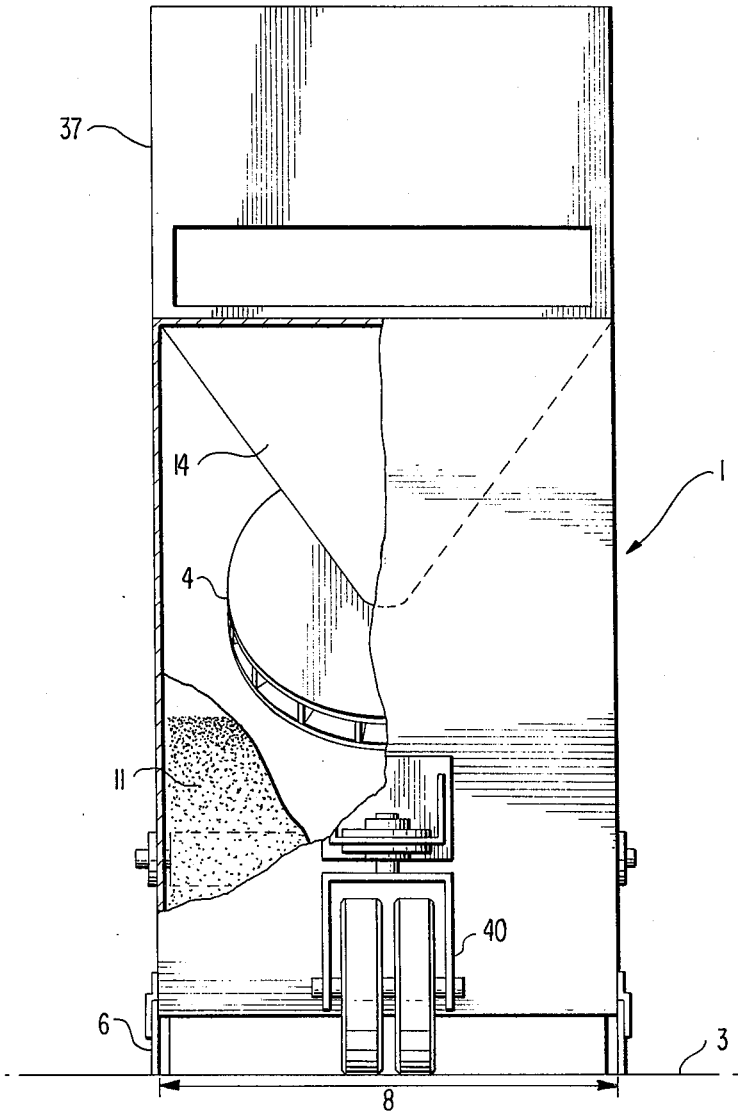
FIG. 2 is a front view of the surface treating machine of FIG. 1.
Figure 3:
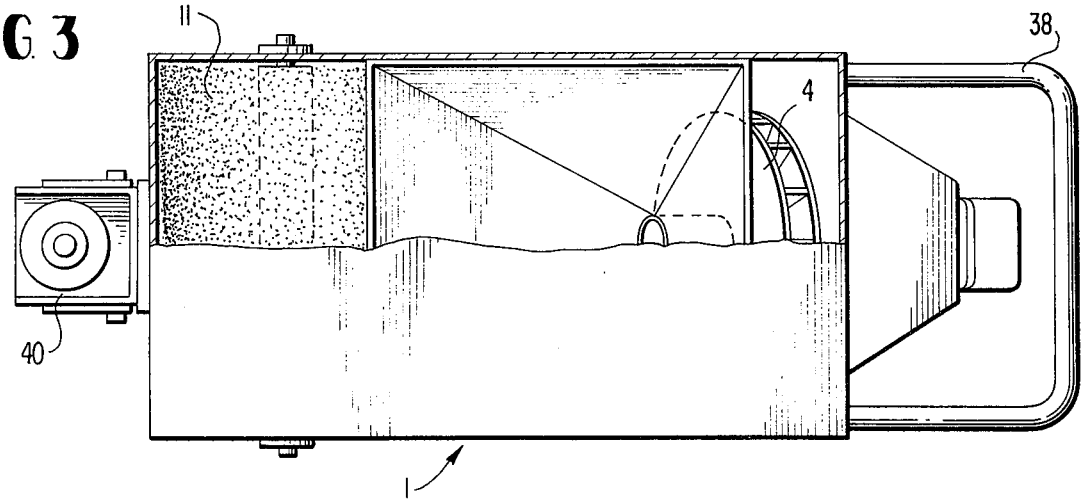
FIG. 3 is a top view of the surface treating machine of FIG. 1.

Referring to the Figures, there is depicted an abrasive throwing machine adapted for treating substantially flat, horizontal surfaces. The machine comprises an enclosure generally designated as 1. The enclosure has an opening 2 therein adapted to confront a surface 3 to be treated with abrasive material. A centrifugal, airless, blast wheel 4 is provided within the enclosure for projecting a stream 5 of abrasive particles 7 at an inclined angle relative to the surface 3 to be treated. Resilient sealing means 6 is provided around the periphery of the opening 2. The resilient sealing means 6 contacts the surface 3 and substantially prevents the escape of spent abrasive from enclosure 1. Abrasive particles 7 strike surface 3 within a blast zone 8. Spent abrasive particles 9 rebound upwardly along a rebound path generally designated as 10. This rebound path is also inclined at an angle relative to the surface 3. The rebounding particles 9 are propelled by a brush 11 rotating in a counterclockwise direction. Brush 11 takes the uncontrolled stream of rebounding particles 9 and converts them into a controlled stream 12, which is fed to a second brush 13 rotating in a clockwise direction. It will be understood that some of the bristles of brushes 11 and 13 have been deleted for convenience of illustration. The controlled stream 12 of spent abrasive particles is returned to a storage hopper 14 along path 15. Abrasive particles are then fed to the blast wheel 4 through an inlet port 16 having means 17 therein for controlling the rate of flow of the particles.

It will be apparent from this description that abrasive particles are continuously impacted on the surface to be cleaned, and continuously removed from the surface to prevent substantial accumulation of spent abrasive particles. This permits the operator to vary the speed of the machine, and even operate the machine in a stationary position while efficiently and effectively treating the surface. Since substantially all of the abrasive material remains within the enclosure and is continuously recycled, the overall weight of the machine is less than a machine in which abrasive passes under the resilient seal and accumulates on the surface until it is picked up by mechanical means. The kinetic energy of the rebounding particles carries the particles free of the surface being treated. Thus it will also be observed that the device of this invention effectively utilizes the kinetic energy of the rebounding particles in recovering the particles and returning them along the recycle path to the storage hopper.

The enclosure employed in the apparatus of this invention is generally made of a light-weight material, such as thin gauge steel or aluminum. Portions of the enclosure can be lined with a replaceable, abrasion-resistant material. For example, with reference to FIG. 1, the housing 18 in which the blast wheel 4 is installed can be lined with manganese steel, cast alloys or hardened plate. This is conveniently accomplished by using replaceable liners of the type well known in the art. Similarly, other surfaces of the enclosure subjected to wear can be lined with an abrasion-resistant material. Thus, the portion of the enclosure surrounding the rotatable brushes can be similarly coated or lined.

The resilient sealing means around the periphery of the opening in the enclosure substantially impedes the escape of spent abrasive particles from the enclosure. The seal should be comprised of a material that is sufficiently resilient to pass over or around obstructions on the surface being treated, yet confine spent abrasive within the enclosure. Elastomeric materials for this purpose are well known in the art.

Any type of conventional abrasive material can be used in the device of this invention. For example, one can use metal shot, slag, sand, volcanic ash, glass beads, metal oxide particles, zircon, garnet, carborundum, stone, etc. Metal shot of substantially spherical shape is preferred because of its durability and its effects on the surface being treated. Spherically shaped abrasive gives a good blast pattern and profile on the treated surface. While angular-shaped particles can also be employed, the profile of the treated surface is frequently characterized by peaks and valleys. When the treated surface is to be painted, a peak can penetrate the paint film, later serving as a locus for the formation of rust and deterioration.

Any of the well-known means for projecting abrasive particles against a surface to be treated can be employed in the device of this invention. A preferred abrasive throwing means is the airless centrifugal blast wheel described in U.S. Pat. No. 3,867,791.

A preferred airless, centrifugal blast wheel has a diameter of about 12 inches and operates at about 3400 rpm. The abrasive is projected toward the surface being treated at the rate of about 100 pounds to about 800 pounds per minute for a machine having a blast zone about 18 inches wide. The rotational speed of the blast wheel and the quantity of abrasive required for blast zones of other dimensions can be readily determined with a minimum of experimentation. A particularly preferred centrifugal wheel for use in an apparatus for treating horizontal surfaces has a diameter of about 12 inches, a rotational speed of about 3400 rpm and an abrasive flow rate of about 500 pounds per minute for a blast zone about 18 inches wide.

The abrasive material is projected against the blast zone on the surface being treated at an angle of about 10° to about 60°, preferably about 15° to about 45°, relative to the surface. An angle of about 30° is particularly preferred. These angles assure that the abrasive material will rebound in an angular direction. Most of the abrasive particles will rebound at substantially the same angle as they strike the surface. Other particles, however, will rebound at a different angle giving rise to the uncontrolled stream of rebounding abrasive.

The rotatable means for returning spent abrasive to the projecting means converts this uncontrolled stream of rebounding abrasive into a controlled stream. By this it is meant that the rebounding particles are directed along the recycle path to the propelling means. The rotatable means also acts to impart force to the rebounding particles in order to project the spent abrasive particles along the recycle path to the storage hopper. Thus, it will be apparent that the rotatable means imparts momentum to substantially all of the particles while changing the direction of at least some of the particles.

Typical of the rotatable means for propelling the spent abrasive particles rebounding from the surface being treated are brushes or rotating paddles. Brushes are preferred because of their availability, cost and light-weight construction. Preferred brushes are comprised of synthetic bristles, such as polypropylene, nylon or urethane. Polypropylene and nylon bristles are particularly preferred because of their lower cost. The particularly preferred brushes for use in the apparatus of this invention have an outside diameter of about 14 inches. The brush should preferably be at least as wide as the blast zone in order to assure that all of the rebounding abrasive particles are guided and thrown along the recycle path to the projecting means. Each bristle is an elongated resilient material having a diameter of typically about 0.030 to about 0.050 inches, although other dimensions can be employed. The brushes can conveniently be employed as a two-part assembly adapted to fit a rotating shaft.

The rotatable means preferably operates at the same tangential speed as the speed of the rebounding particles. This minimizes clogging of the rotatable means and minimizes wear on said means.

The brushes can be driven by conventional means. For example, a belt or chain and pulleys or sprockets can be employed. In FIG. 1, 19 represents a drive sprocket, 20 an idler sprocket, 21 a sprocked fixed to a shaft 22 passing longitudinally through brush 11, and 23 a sprocket fixed to a shaft 24 passing longitudinally through brush 13. A chain 25 transmits the force from drive sprocket 19 to idler sprocket 20, past sprockets 21 and 23, thereby resulting in the rotation of the brushes. In a particularly preferred device for cleaning horizontal surfaces, the lower brush 11 rotates at a speed of about 450 rpm, while the upper brush 13 rotates at a speed of about 350 rpm. Other speeds could, of course, be employed. For example, if a single brush is employed to propel the rebounding particles along the recycle path to the projecting means, the rotational speed could be increased in order to assure that sufficient momentum was imparted to the rebounding particles to insure their return to the storage hopper. Such an arrangement would be especially effective with light-weight abrasive material. Under ordinary conditions, the tangential speed of the brushes should not greatly exceed the velocity of the rebounding particles in order to avoid excessive wear of the brushes. It will be understood, however, that the rebounding particles can even be accelerated by the brush or brushes.

While the apparatus of this invention has been described in terms of one or two rotating brushes, it will be understood that rotatable means in series can also be employed. For example, three or more rotating brushes in series can be employed to raise the spent abrasive particles to elevations considerably above the surface being treated.

When two brushes are employed in series as depicted in FIG. 1, it is preferred to reduce the cross-sectional area of portion of the enclosure between the rotating brushes in order to assure that the abrasive particles are fed to the second brush at an optimum angle. This avoids clogging, excessive wear and damage to the second brush depicted as 13 in FIG. 1.

The rotatable means for propelling the spent abrasive particles along the recycle path can contact the surface or be removed from the surface being treated. When the rotatable means comprises rotatable paddles, the paddles will generally be removed from the surface in order to minimize wear. When the rotatable means comprises a brush, the brush can be removed from the surface or contact the surface. A brush contacting the surface is especially desirable when one is treating a surface to be painted where it is desirable to brush the surface prior to painting in order to dislodge and remove foreign matter. In any case, when the apparatus is employed for treating horizontal surfaces, the rotatable means should be relatively close to the surface being treated because the spent abrasive particles rebound upwardly only a short distance. Therefore, the rotatable means must be near enough to the surface to prevent the spent abrasive particles from falling back onto the surface before they are struck by the rotatable means and thrown along the recycle path. The distance between the rotatable means and the surface being treated is usually not as important if the aapparatus is being employed to treat vertical or inclined surfaces.

In the particularly preferred apparatus of this invention, the distance between the center line of the rotatable brush 11 and the surface 3 being treated is about 16 inches, while the distance between the center lines of brush 11 and 13 is about 18 inches. Optimum dimensions for a given application can be readily ascertained with a minimum of experimentation.

The device depicted in FIG. 1 is designed for movement in the direction indicated by the arrow at the base of the Figure. The center line of the rotatable brush 11 is depicted in front of the blast zone 8. The rotatable brush could as well be mounted in approximately the position now occupied by sprocket 19 provided that the bristles of the brush extend into the rebound path 10 of the spent abrasive particles 9. In other words, it will be understood that the relative location of the rotatable means can be adapted to a particular application, provided that the rotatable means is within the enclosure or at least in communication with the rebound path defined by the rebounding spent abrasive particles.

In a preferred embodiment of this invention, the opening 2 in the enclosure 1 has a front area generally designated as 26 in FIG. 1 and a rear area generally designated as 27. The front area 26 and rear area 27 are outside the blast zone. When the device depicted in FIG. 1 is used for treating horizontal surfaces, there may be a tendency for a small amount of spent abrasive to collect in the rear area 27 outside the blast zone 8. It is advantageous to recirculate this spent abrasive, even though the quantity might be quite small. This can be accomplished by providing means for forcing spent abrasive in the rear area 27 back into the blast zone 8 in order that fresh abrasive 7 will strike the spent abrasive and blast it from the surface along the rebound path 10. This can conveniently be accomplished by providing the entry of a fluid, such as a gas, preferably air, in the rear area 27. This can be accomplished by providing the portion of the resilient seal 6 adjacent rear area 27 with at least one passage to permit the entry of the gas. Preferably, this portion of the resilient seal comprises a resilient brush means 28 adjacent to the rear area 27. Brush means 28 permits the flow of air along the path generally indicated as 29 in FIG. 1. This flow of air passes over the blast zone 8 and through the enclosure along the rebound path 10 and recycle path defined by 12 and 15. This flow of air makes a very small contribution to the return of spent abrasive particles to the storage hopper 14. That is, a small quantity of abrasive and foreign matter will be carried by the air stream as it passes along rebound path 10, past brush 11, past brush 13 and along path 15 to hopper 14. The main function of the auxiliary air supply is, as previously indicated, to force spent abrasive material collecting in the rear area 27 back into the blast zone 8. When the device is operating at high speed, the auxiliary air flow also aids in cooling the machine and the surface being treated.

This auxiliary air flow 29 is especially advantageous when the machine is operated at low speeds or in a stationary position, since it prevents large quantities of spent abrasive from collecting in the rear area 27 of the opening 2. It will be understood that a similar auxiliary air flow can be provided in the front area 26 if the collection of spent abrasive particles in this area becomes a problem. This might occur, for example, when the device is operated in a stationary position.

When the device is mobilized and used for cleaning horizontal surfaces, any spent abrasive that collects in the front area 26 will enter the blast zone 8 as the machine moves forward. In this instance, it generally will not be necessary to include auxiliary air in the front area 26.

Brush means 28 not only permits the passage of air into the rear area 27 of the opening 2, but also restrains spent abrasive from escaping from the opening.

The auxiliary air flow 29 can be provided by means of a vacuum or a forced air system. For example, the enclosure could be connected to means for providing a vacuum within the enclosure. Air could then enter the brush means 28 in the lower portion of the enclosure. When a vacuum system is employed, it is preferable to connect the storage hopper 14 to the blast wheel 4 by means of a substantially air-tight seal in order to prevent short-circuiting of the air flow. The auxiliary air flow 29 can also be provided by means capable of supplying air at a positive pressure near the brush 28. In this instance, it is not as important that the seal between the storage hopper 14 and blast wheel 4 be air-tight, since air is being forced into the rear area 27; air drawn into the blast wheel 4 at the seal between the blast wheel 4 and hopper 14 will, therefore, not prevent the auxiliary air flow 29 from performing its intended function.

It has been found that the auxiliary air flow 29 should be of substantially high volume and low pressure or vacuum. In the preferred device previously described, an air flow of about 1000 cfm at 10 in $H_2O$ and ambient temperature has been found to be adequate. Other flow rates and pressures can be employed provided that the flow is sufficient to force spent abrasive in the rear area 27 into the blast zone 8. It will be understood that the auxiliary air flow 29 should not disrupt or disturb the abrasive particles 7 along their inclined path 5 or the spent abrasive particles 9 along their rebound path 10. Thus, very high pressures and air flow rates will generally be avoided.

When an auxiliary air supply is employed, it proceeds along the path 10 and path 15. When the spent abrasive particles fall into hopper 14, the air continues along the path designated as 31. It will be apparent that air sweeps through the descending particles 30 along the path designated 31. This results in an air washing of the spent abrasive particles. Foreign material removed from the surface being treated can effectively be removed from the spent abrasive particles in this manner.

As the air proceeds along the path 29, it carries with it a small quantity of spent abrasive designated as 32 in FIG. 1. The air is permitted to pass through an expanded area generally designated as 33. This results in a decrease in the flow rate of the air. Abrasive particles 32 then fall by the action of gravity into the trough 34. Trough 34 is provided with an adjustable gate 35, preferably constructed of a resilient material such as rubber. Abrasive particles collect above the adjustable gate 35, and eventually trickle back into the storage hopper 14. The air then proceeds along the path designated as 36 in FIG. 1. The air can then be passed through a dust collector to remove foreign material picked up from the surface being treated. The dust collector is an optional embodiment that is preferred when it is important to control air pollution. The dust collector can be part of the apparatus or remote from the apparatus. A remote dust collector is preferred where the weight of the machine is a critical factor, such as in the cleaning of the tops of storage tanks. In cleaning roadways, however, weight is not as important a factor, and the entire surface treating apparatus and dust collector system can be mounted on a single mobile unit, such as a truck body.

The device depicted in FIG. 1 is provided with a removable top 37. This permits the operator to service the machine. Fresh abrasive material can be added to the storage hopper when the top is removed and the upper brush can be serviced. The portion 41 of the enclosure 1 can also be constructed for easy removal. This permits the operator to service the lower brush 11.

The apparatus can also be provided with a steering handle, such as 38 in FIG. 1. The apparatus can be self-propelled by providing one or more drive wheels 39 near the rear of the machine. A caster wheel assembly 40 can be provided in the front of the machine. Controls for regulating the speed and direction of the machine, the speed of the throwing device and the rotational speed of the brushes can be mounted on steering handle 38. It will be apparent that the rate of travel of the machine can be adapted to suit a particular appliction. Preferably, variable speed controls are provided.

The device depicted in FIG. 1 is designed to travel close to the surface being treated. The central portion of the machine can hang-up on obstructions or irregularities on the surface. This can be avoided by placing drive wheels 39 in an area adjacent to the blast zone 8, bu t still outside the enclosure 1. The device can then ride over obstructions and irregularities on the surface.

The surface treating machine, rotating brushes and blast wheel can be powered by conventional means. For example, hydraulic, electric or pneumatic drive means can be employed. Hydraulic drive means are preferred when the weight of the machine is an important consideration. Hydraulic motors, for example, are generally lighter in weight than electric motors.

The opening 2 in enclosure 1 is generally of a rectangular or square shape, although other shapes can be employed. For example, an oval or oblong opening can also be employed. A rectangular or square opening permits the operator to move the blast zone closer to obstructions on the surface being treated. Thus, for example, the operator will be able to move the machine close to columns projecting through the floating roofs of storage tanks.

The particularly preferred device of this invention has been described as having an 18 inch wide blast zone. It will be understood that blast zones of other dimensions are contemplated, and can be provided by proper selection of the abrasive projecting means. For example, where a wide blast zone is desired, two or more centrifugal blast wheels can be arranged side-by-side. A wide blast zone is frequently advantageous because it permits the treatment of a larger surface area per hour of operator time than a narrow blast zone.

It will be understood from the foregoing discussion that the device of this invention can be used on vertical, horizontal or inclined surfaces. It will also be understood that the device of this invention can be mobilized or operated in a stationary position. While the device has been described as being mobile and especially adapted for use in cleaning substantially flat, horizontal surfaces, it will be understood that the device can be operated in a stationary position, and the surface being treated moved past the opening in the enclosure. It will also be understood that both the device and the surface being treated can be stationary. Of course, the device of this invention would not be employed for treating a single surface in this manner for an extended period of time unless it was desired to substantially abrade the surface being treated.

The device of this invention possesses several advantages. It can be operated in a stationary position or it can be mobilized. In either case, spent abrasive particles are prevented from accumulating in large quantities on the surface being treated. Secondly, the blast zone is of a substantially constant size because abrasive particles are continuously removed from the surface being treated. The device of this invention is compact, making it relatively maneuverable. Furthermore, since the abrasive material is continuously removed from the surface and recycled to the throwing means, the amount of abrasive is small relative to that required in prior art devices. This reduces the overall cost of operation and the weight of the machine, making the machine especially suitable for cleaning the tops of storage tanks. Additionally, the energy of the rebounding particles is not wasted. This is accomplished by preventing most of the rebounding particles from returning to the surface being treated. As the machine moves forward, abrasive is continuously blasted at the surface being treated, and is continuously recycled. The forward speed of the machine can be changed without surges of spent abrasive particles clogging the recycle mechanism.

What is claimed is:

1. In an abrasive throwing machine comprising an enclosure having an opening therein, sealing means around the periphery of said opening in said enclosure to contact a surface to be treated and to retard the escape of spent abrasive from said enclosure, means within said enclosure for projecting abrasive particles along an incident path to a blast zne on said surface and from the blast zone along a rebound path, said projecting means being oriented to establish both said incident path and said rebound path at acute angles relative to said surface, and means for returning spent abrasive along a spent abrasive recycle path to said projecting means, the improvement wherein said means for returning spent abrasive to said projecting means includes a rotatable means positioned in said rebound path for propelling spent abrasive particles along said recycle path.

2. Machine of claim 1 wherein said machine includes means for mobilizing said machine.

3. Machine of claim 2 wherein said opening in said enclosure has a front area and a rear area outside said blast zone, said front area being toward the direction of movement, and said machine includes means for providing a fluid under conditions sufficient to force spent abrasive in said rear area into said blast zone.

4. Machine of claim 3 wherein said fluid is air and the portion of said resilient seal adjacent said rear area includes at least one passage to permit the entry of said air into said rear area to force spent abrasive in said rear area into said blast zone.

5. Machine of claim 4 wherein the portion of said resilient seal having said at least one passage is a brush means.

6. Machine of claim 5 wherein said rotatable means within said enclosure is a brush means having a substantially circular cross-section.

7. Machine of claim 1 wherein said rotatable means within said enclosure is a brush means having a substantially circular cross-section.

8. Machine of claim 7 wherein said means for projecting abrasive particles is a centrifugal, airless blast wheel.

9. In a mobile abrasive blasting machine for treating substantially horizontal surfaces, said machine comprising an enclosure having an opening therein adapted to confront said surface, at least one centrifugal blast wheel within said enclosure for projecting abrasive particles along an incident path to a blast zone on said surface and from the blast zone along a rebound path, said blast wheel being oriented to establish both said incident path and said rebound path at acute angles relative to said surface resilient sealing means around the periphery of said opening in said enclosure to contact said surface and to substantially retard the escape of spent abrasive from said enclosure, and means for returning spent abrasive along a spent abrasive recycle path to said blast wheel, the improvement wherein said means for returning spent abrasive to said blast wheel includes at least one rotatable brush positioned in said rebound path for propelling spent abrasive particles along said recycle path, said rotatable brush positioned in front of said blast zone and removed from said surface, a rear portion of said resilient sealing means including a second brush means having passages therethrough for the entry of air into said enclosure, and means for drawing air through said second brush means.

10. A method for treating a surface, said method comprising

A. projecting abrasive particles at an inclined angle relative to said surface to abrade said surface and to cause said particles to rebound from said surface; and B. striking saiid rebounding particles and throwing said particles along a predetermined path.

* * * * *